US005947352A

United States Patent [19]

Parsons

[11] Patent Number: 5,947,352

[45] Date of Patent: Sep. 7, 1999

[54] QUICK-RELEASE SCABBARD FOR BATONS

[75] Inventor: Kevin L. Parsons, Appleton, Wis.

[73] Assignee: Armament Systems and Procedures, Inc., Appleton, Wis.

[21] Appl. No.: 09/014,099

[22] Filed: Jan. 27, 1998

[51] Int. Cl.[6] ..... A45F 3/14

[52] U.S. Cl. ..... 224/250; 224/255; 224/914

[58] Field of Search ..... 224/250, 911, 224/914, 251, 245, 243, 255, 901.4

[56] References Cited

U.S. PATENT DOCUMENTS

| | | | |
|---|---|---|---|
| 5,056,819 | 10/1991 | Hayes | 224/250 |
| 5,358,159 | 10/1994 | Lundie, Jr. | 224/245 |
| 5,513,786 | 5/1996 | Drane | 224/188 |
| 5,669,170 | 9/1997 | Norris | 42/85 |
| 5,819,381 | 10/1998 | Lake | 24/564 |

*Primary Examiner*—Allan N. Shoap
*Assistant Examiner*—Maerena W. Brevard
*Attorney, Agent, or Firm*—McDonnell Boehnen Hulbert & Berghoff

[57] ABSTRACT

A scabbard for carrying a baton on the torso of a user in a manner such that the baton may be quickly released from the scabbard and placed into use. The baton includes a handle to be grasped by the user having a first end portion which is releasably secured to the scabbard. The scabbard includes an elongated strap adapted to be worn about the torso of the user having a first end and a second end. The first end includes a means for fasting the strap to an article of clothing or equipment worn by the user. The second end is likewise adapted to be retained by a belt or other clothing or equipment worn by the user, preferably proximate to the waist of the user. A retaining means such as a snap is affixed to the second end of the strap, which releasably attaches to a complementary structure in the end portion of the baton. A loop is also provided which is attached to the strap between the first and second ends. The loop is positioned relative to the second end of the strap such that the baton is received within the loop when the first end portion of the baton is releasably secured to the retaining means. The baton is released from the scabbard by a quick upward motion to release the end of the baton from the retaining means, followed by a swift downward stroke. The downward stroke whips the baton out to an extended, operational condition at the same time as the baton is released from the retaining loop.

21 Claims, 4 Drawing Sheets

QUICK-RELEASE SCABBARD FOR BATONS

BACKGROUND OF THE INVENTION

1. Field of the Invention

This invention relates generally to the field of police and law enforcement equipment. More particularly, the invention relates to a scabbard that retains a baton, such as an expandable tactical police baton, on the torso of the officer in a convenient and secure manner, yet permits the baton to be immediately released and used when the need arises.

2. Description of Related Art

Expandable batons for police use have become popular with law enforcement agencies since the late 1980s with the advent of a baton now generally known as the ASP® baton. This baton is described in U.S. Pat. No. 5,348,297, assigned to Armament Systems and Procedures, Inc, the assignee of the present invention. Before describing the scabbard that is the subject of the present invention, a brief discussion of expandable batons and the baton of the '297 patent is provided to help place the invention in the proper context.

The expandable baton of the '297 patent is shown in FIGS. 1A and 1B. The baton 1 has a plurality of telescoping sections, including a main section 2 that serves as a handle, a larger middle telescoping section 10, and a smaller end telescoping section 11. The three sections are co-axial hollow tubes of heat-treatable steel. A smooth knob 12 is threaded onto the end of the smaller section 11 to allow the baton to be used with a reduced risk of inflicting injury. An end cap 4 is threaded onto the end of the main section. A foam cover 3 provides a comfortable grip for the baton. A leaf spring 6 retains the smaller section 11 when the baton is collapsed.

The larger telescoping section 10 is flared on one end to mate with a swaged end of the main section 2 when the baton is in its extended position. The other end of the telescoping section 10 is swaged to mate with a flare formed on the smaller telescoping section 11. The swage and flare features form deadlock taper joints 15 when the flared end of the smaller diameter section is jammed tightly into the corresponding swaged end of the larger diameter section, as illustrated in FIG. 1B. The baton is expanded from its collapsed condition to an extended position in a quick whipping action. The baton is collapsed by a strong axial blow to one end.

One of the reasons that expandable batons have become popular is that tubular weapons that are handle heavy (such as an expandable baton), as opposed to heavy on the striking surface (such as a traditional long baton), are easier to control. Additionally, expandable batons cause less tissue damage because they are lighter in weight. Lighter weight batons tend to give bouncing injuries, instead of crushing injuries, which are more permanent.

Expandable batons are also a desirable component of standard police equipment because they can be more easily carried by the officer and available for use, as compared to standard nightsticks or long batons. Studies have shown that police often leave their long batons in their car. In a typical scenario, police officers would get out of their car and one of two things would happen when they needed to control a subject. Either the police would strike the suspect with something that was not appropriate (such as a flashlight or radio), since their baton was in the car, or they would go to a higher level of force and use a firearm. In addition to causing unnecessary tissue damage, an inappropriate device may simply fly apart after being used as a baton. This, of course, leaves the officer without an immediate force weapon. Further, after using an "improvised baton," such as a radio or flashlight, which flies apart, the officer is left without these tools in dealing with the subject (e.g., he/she may now be unable to call by radio for help or find his/her way along a dark corridor). Of course, the use of an inappropriate item, such as a radio or flashlight, as a baton requires the police force to unnecessarily buy replacement radios and flashlights, thus increasing the overall cost of law enforcement.

Expandable batons are lighter in weight, handle heavy, and telescope to a convenient size of less than 20 inches in length. Thus, they meet the needs of law enforcement for an impact intermediate force weapon.

In order for an expandable baton to be of maximum utility to the officer or other baton user, it should be able to be carried by the officer at all times while on duty, and without interfering with the mobility of the police officer when it is not needed. The baton should allow full arm movement and allow the officer a reasonable degree of comfort when worn throughout the day, including those times that the officer is sitting or standing for extended periods of time.

Additionally, there are many instances in which the baton may need to be carried in a concealed manner (for example, under a coat), and yet still be quickly accessible and ready for use. The ability to conceal the baton is especially important, for example, when a police officer is assigned the task of attending staid functions for dignitaries, and the officer's weapons must be concealed under semi-formal or formal clothing. Longer batons are more difficult to conceal, given their substantial length. In addition, the baton must be able to be deployed by the officer quickly whenever needed (i.e., virtually immediately). Further, the baton must be held securely on the police officer's body during the officer's daily activities. Such activities may loosen the baton significantly, such as when the officer is pursuing a subject and may be required to run, jump, climb over walls or fences, or move quickly up or down stairs. When the officer reaches a subject, however, the baton must still be ready for use on the officer's body.

Further, the scabbard must not provide a "handle" that may be grasped by a subject, allowing the subject to more easily maneuver the officer into a physically dangerous position. Of course, it is generally important that a police officer's baton be held securely to his/her body regardless of the physical activities of the officer, and that the baton is not able to be grasped and taken by a suspect during a physical confrontation. However, it is even more important that the scabbard not enable the subject to pull or push the officer. While losing the scabbard while running or during a confrontation is serious, allowing a subject to pull an officer to the ground (where he lacks mobility and is more easily beaten) or into the path of a moving vehicle is a substantially greater hazard to the officer's life.

It is therefore apparent that the baton scabbard is an extremely important aspect of the overall performance and utility of the baton. Prior art scabbards often failed to meet such needs. For example, some scabbards have been attached to the belt of the officer such that the baton is worn at the side. In such cases, the baton is not effectively concealed. Further, they positioned the baton where it might be more easily grasped by a subject. Further, such scabbards were firmly attached to an officer's body, allowing the subject who grabbed the baton to more easily push or pull the officer. Further, many prior scabbards were clumsy to use and uncomfortable to wear. Indeed, as discussed above, the shear inconvenience of wearing a baton may induce some officers to leave their batons in their vehicles. As a result, the batons are not readily available when needed outside of the vehicles.

The present invention provides for a scabbard that achieves the above objectives. The scabbard retains the baton securely on the body of the wearer. The inventive scabbard adjusts to many different size batons. The scabbard also provides for quick release of the baton for substantially immediate use by an officer.

Additionally, the scabbard is worn about the torso, such that the baton is positioned against the chest of the user when not in use. This placement of the baton on the torso, coupled with fact that the scabbard is not bulky, makes the scabbard comfortable and permits the baton to be concealed under a coat. The scabbard also positions the baton on the body such that the baton has a negligible adverse affect on the mobility or movement of the officer, and in particular it does not interfere with arm motions and will not fall out when the officer is engaged in running or jumping types of activity. Further, some embodiments of the scabbard includes a "high-pressure" attachment release feature such that the scabbard will become detached from the officer's body should enough force be applied to it. This might occur, for example, should a subject grab the scabbard and attempt physically to maneuver the officer. The release feature substantially reduces the risk that the subject can push or pull the officer to the ground.

The scabbard is adjustable to accommodate different size officer, and adapts to either right-handed or left-handed officers. The scabbard is also adjustable to accommodate a full range of baton sizes. By virtue of the baton having a safety release, such that there is less risk that a suspect will successfully grab or forcibly remove the baton from the officer or grasp the scabbard as a "handle" to physically maneuver the officer.

SUMMARY OF THE INVENTION

A scabbard is provided for carrying a baton on the body of user in a manner such that the baton may be quickly released from the scabbard and placed into use. The scabbard includes an elongated strap adapted to be worn about the torso of the user having a first end and a second end. The first end includes a means for fasting the strap to an article of clothing or equipment worn by the user. The second end is likewise adapted to be retained by a belt or other clothing or equipment worn by the user, preferably proximate to the waist of the user.

A retaining means is affixed to the second end of the strap, which cooperates with structure in the end portion of the baton handle to releasably secure the baton to the scabbard. In the illustrated embodiment, the retaining means is a male snap element that snaps to a female snap element incorporated into the end cap on the baton handle.

The scabbard further includes a baton-receiving loop attached to the strap between the first and second ends. The loop is positioned relative to the second end of the strap such that the baton is received within the loop when said first end portion of the baton is releasably secured to the retaining means.

In a preferred embodiment, complementary hook and pile fastener is applied to the interior of the loop and the rear surface of the strap, respectively, thereby enabling the loop to be securely positioned in a multitude of positions intermediate the first and second ends of the strap and accommodate batons of varying length.

In a preferred embodiment the means for fastening the first end of the strap to the clothing or equipment of the officer has a break-away feature, in which the end of the strap disengages from the clothing or equipment if sufficient pull-out forces are applied to the strap. This would be the case, for example, if the suspect grabbed the strap and attempted to pull the officer to the ground. The means for fastening in the illustrated embodiment is a locking clasp with sharp teeth in opposed pairs of jaws that affixes to the officer's trousers. The jaws either give way from the trousers or rip the trousers such that the strap becomes disengages from the clothing when sufficient pull-out forces are applied to the clasp.

In another embodiment of the invention, the second end of the strap further comprises a second loop, which receives a belt worn about the waist of the user. The loop may be either permanently formed at the second end of the strap, or, more preferably, may be formed by providing an extension of strap material at the second end of the strap having a free end, and fastening this free end back onto the strap to form a loop at the time the scabbard is put on the user. In the latter embodiment, the free end of the extension is preferably constructed so as to prevent release of the extension from the strap, ensuring that the action of the user releasing the end of the baton from the retaining snap means is accomplished.

Once the scabbard is placed on the torso and secured to the user's clothing or equipment, the baton is secured to the scabbard by placing one end of the baton inside the baton-receiving loop and connecting the other end of the baton handle to the retaining means. The baton is quickly released from the scabbard by grasping the handle of the baton, lifting the baton upward in a short, swift stroke to release the end of the baton handle from the retaining means, and then quickly moving the baton downward out of the baton-receiving loop in a short, sweeping motion across the body. The baton is not only quickly freed from the scabbard, at the same time as the baton is removed from the scabbard it is whipped open into an extended, operational condition, ready to be used as an impact or defensive weapon.

These and many other features and advantages of the invention will be more completely described below in the detailed description of presently preferred embodiments of the invention.

BRIEF DESCRIPTION OF THE DRAWINGS

A presently preferred embodiment of the invention is described below with reference to the drawings, in which like reference numerals refer to like elements in the various views, and in which.

DETAILED DESCRIPTION OF THE PREFERRED AND ALTERNATIVE EMBODIMENTS OF THE INVENTION

Figure 2B:
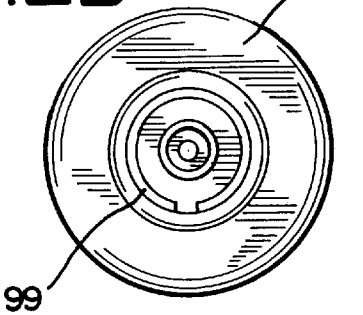
FIG. 2B is an end view of the baton of FIGS. 1A and 1B, showing the female snap element incorporated into the end cap which cooperates with a complimentary baton retaining snap element of FIG. 2A.
Figure 2:
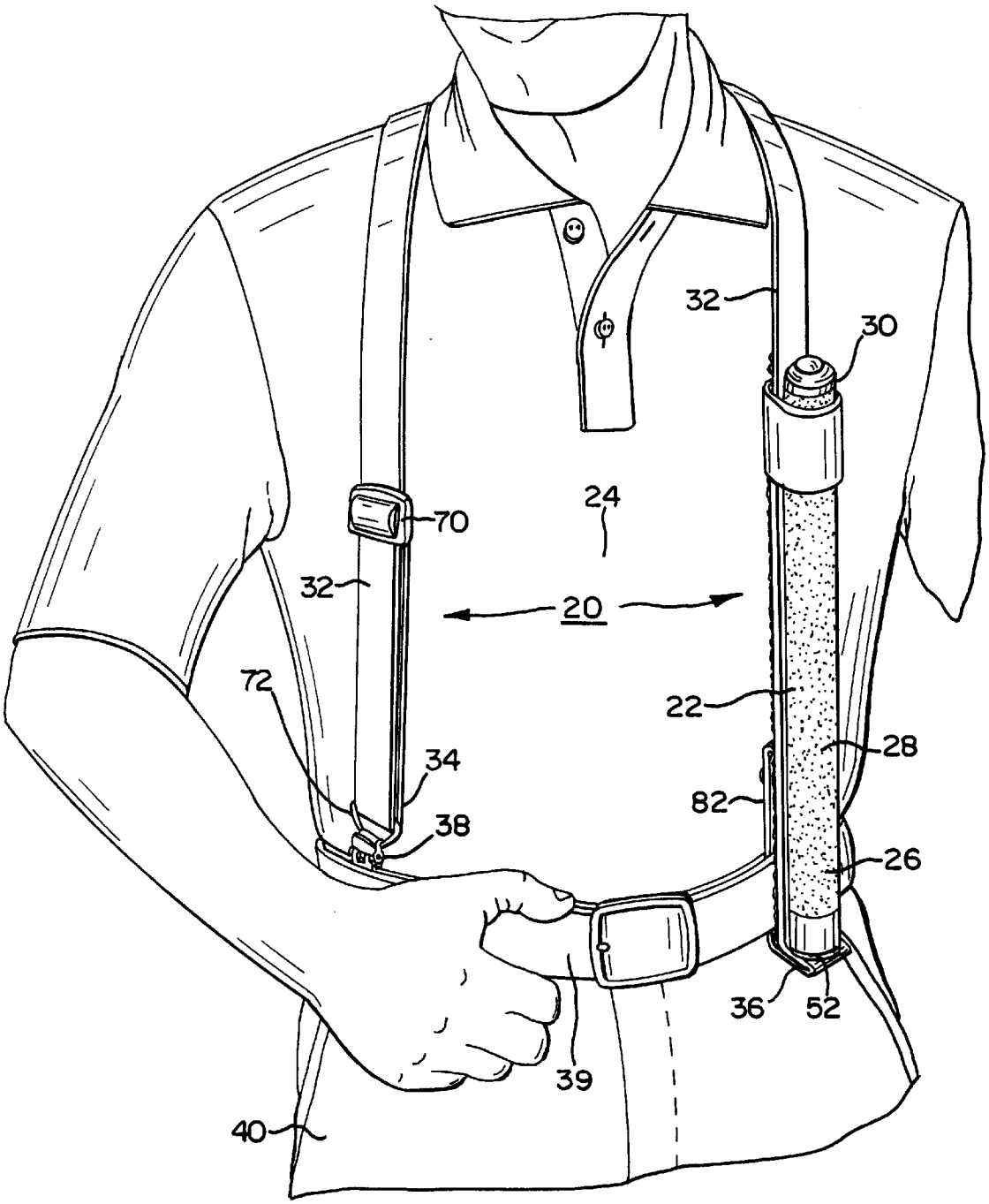
FIG. 2 is a perspective view of a preferred embodiment of the scabbard worn by the user, with the baton retained in place by the scabbard against the torso of the user.

Referring to FIG. 2, a scabbard 20 in accordance with a presently preferred embodiment of the invention is shown. The scabbard 20 is designed to retain an expandable baton 22. The type of baton generally described in the above-referenced U.S. Pat. No. 5,348,297 and manufactured by Armament Systems and Procedures, Inc is certainly suitable for use with the inventive scabbard, but, of course, other expandable batons manufactured by other companies in the industry are also suitable for use with the scabbard. Shorter non-collapsible batons could also be carried by the scabbard 20.

The scabbard 20 includes an elongated strap 32 made of a strong, lightweight non-stretch nylon webbing or other suitable material. The strap 32 is not bulky and fits flat against the torso. The strap 32 includes a first end 34 and a second end 36. In the illustrated embodiment, the strap 32 is worn such that one end 34 attaches to the clothing or equipment in the front of the user, the strap 32 extends upwardly along the front of the torso, behind the neck, and down across the front of the torso on the other side, as shown. As can be seen in FIG. 2, the scabbard 20 is worn on the individual such that the baton 22 is positioned on the front of the torso 24 in a substantially vertical orientation. The lower portion 26 of the baton handle 28 is positioned slightly above the user's waist, with the upper portion 30 of the handle 28 at approximately the shoulder level.

The first end 34 of the strap 32 is provided with a means 38 for fastening the strap 32 to an article of clothing or equipment worn by the user. In the embodiment of FIG. 2, a locking clasp 38 is provided which fastens to the top of the trousers 40 of the user. The actual manner in which the first end 34 attaches to the clothing or equipment is critical, and other possibilities for the fastening means 38 include a loop that receives a belt 39, a set of complimentary locking snap elements (such as described in detail below), or otherwise. The principal requirement for the fastening means 38 is that when the user releases the baton from the scabbard, the fastening means 38 remains secured to the clothing or equipment such that the baton can be readily released.

Additionally, the locking clasp has a break-away feature, in that if the subject grasps the elongate strap connected to the clasp 38 and pulls with sufficient force, the clasp will either break away and release from the trousers, or else the teeth of the clasp (see FIG. 6) will rip the trousers and the clasp will become disengaged from the trousers. This release feature reduces the risk of the scabbard being used to control the officer, such as using it to pull the officer down to the ground.

The second end 36 of the strap 32 is also adapted to be retained to the clothing 39, 40 or equipment worn by the user. In the illustrated embodiment, this is achieved by providing an extension 82 to the end 36 of the strap 32 that fastens to the rear of the strap 32 to form a loop which receives the belt 39 worn around the waist of the user. The construction and function of the extension 82 is described in further detail below.

Figure 2A:
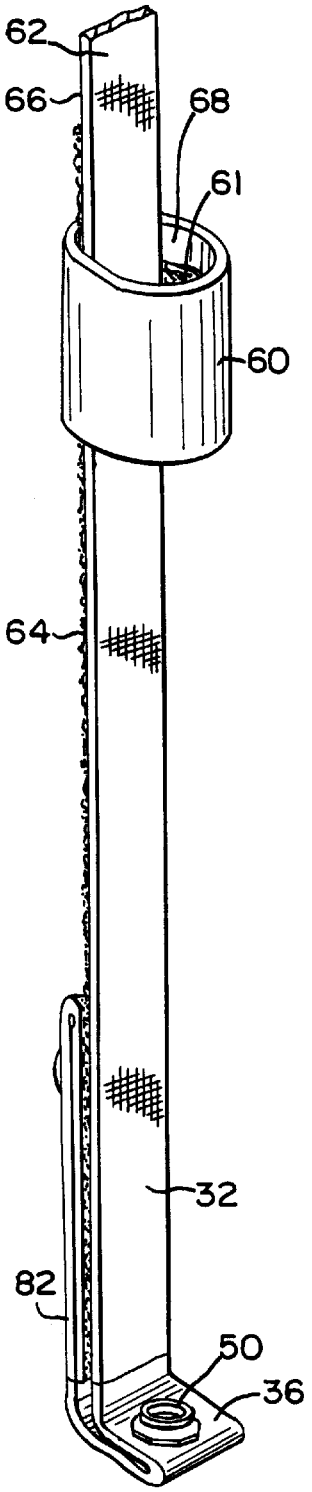
FIG. 2A is a perspective view of a portion of the scabbard with the baton removed in order to better illustrate the-baton retaining snap element that engages with the end of the baton.

The second end 36 of the scabbard further includes a baton retaining means 50, shown best in FIG. 2A, that is affixed to end of the strap 32. The retaining means 50 cooperates with complementary structure incorporated into the end portion or cap 52 of the handle 28 of the baton 22 (FIG. 2) to releasably secure the end portion or cap 52 of the baton to the second end 36 of the strap. In the illustrated embodiment, the retaining means 50 comprises a metal male snap element 50 which is permanently secured to the end 36 of the strap by a rivet or other suitable means. The male snap element 50 is received by a complementary metal female snap element 99 that is incorporated into the end cap 52, as shown in FIG. 2B.

A loop 60 is attached to the strap 32 between the first and second ends of the strap 32. The loop 60 is positioned relative to the second end 36 of the strap such that the upper portion 30 of the baton 22 is received within the loop 60 as shown in FIG. 2 when the baton end cap 52 is releasably secured to the male snap element 50 on the scabbard 20. The strap 32 of FIG. 2 includes a conventional length-adjusting piece 70 that receives the strap 32 and the end of the strap material after the end has passed through the ring 72 on the clasp 38. The user adjusts the length of the elongated strap so that the scabbard 20 is worn snugly across the torso 24, but not so tight as to restrict movement.

The loop 60 is preferably made from an elastic material, and sized such that it has a circumference slightly in excess of the circumference of the baton shaft. When the baton is released, the user may withdraw the baton at an angle, which induces a twist in the loop 60. It is very important that the loop 60 not bind during the motion of withdrawing the baton from the scabbard. The elastic material for the loop 60, and sizing the loop 60 slightly in excess of the circumference of the baton, allows the baton to be readily released without binding.

Figure 2C:
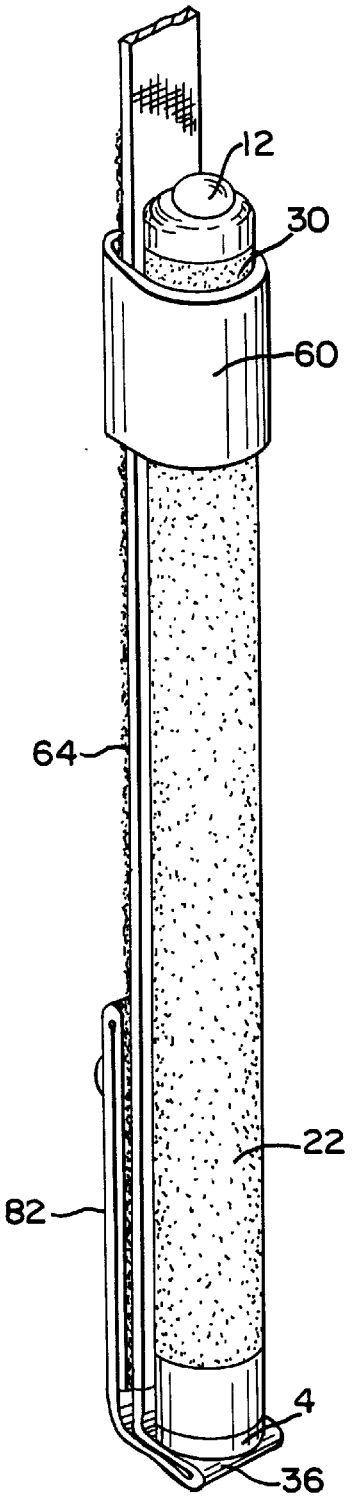
FIG. 2C is a more detailed perspective view of the scabbard and baton of FIG. 2.
Figure 3:
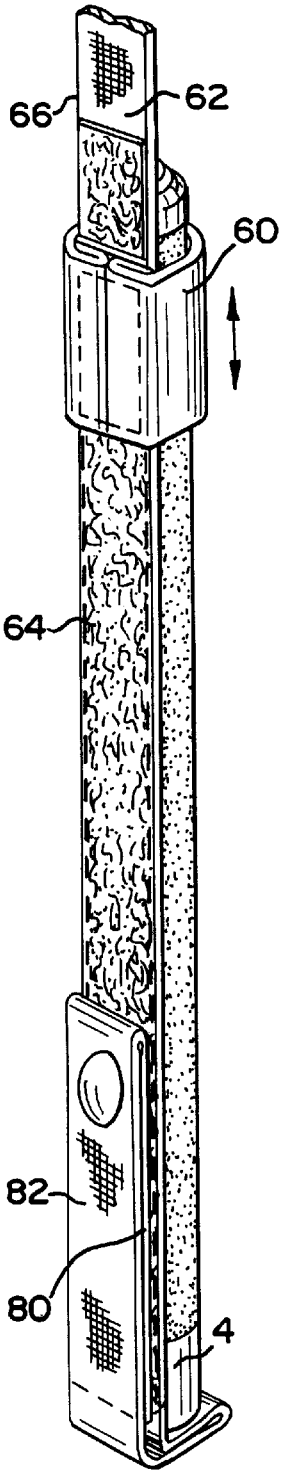
FIG. 3 is a perspective view of the rear portion of the second end of the scabbard, showing the fastener that permits the loop 60 of FIG. 2A to be moved to a plurality of different positions to accommodate batons of different lengths.

One of the features of the scabbard of FIG. 2 is that it is adjustable to accommodate batons 22 of different lengths. Referring to FIGS. 2A, 2C, and 3, this result is achieved by applying a strip of complimentary hook 61 and pile 64 fastener (such as Velcro® material) to the interior portion of the loop 60 and the rear surface 62 of the strap, respectively. For example, the embodiment of FIG. 2 is provided with a strip of pile material 64 having a length of approximately 12–18 inches on the rear surface 62 of the strap. The pile extends from the terminus of the second end 36 of the strap 32 along the rear surface 62 to approximately the location 66 shown in the figure. See also FIG. 3. The closed loop 60 surrounds the strap 32, and the interior 68 of the loop material is provided with a strip of hook fastener 61 which fastens to the pile material 64 on the rear of the strap 32. The user thus can easily locate the loop 60 at the desired distance above the second end 36 of the strap so as to place the end portion 30 of the baton 22 within the loop 60, thereby allowing the baton to be securely carried in the scabbard. Obviously, with longer batons, the loop 60 is placed further away from the second end 36 of the strap. An alternative configuration would be to permanently attach the loop 60 to the strap 32 at a position suitable for a particular size or range of sizes for batons, such as, for example, 8 or 12 inches above the second end of the strap. The scabbard is shown from the rear in a perspective view in FIG. 3, in order to better illustrate the pile material 64 on the rear surface 62 of the strap 32. The arrow indicates the ability of the baton retaining loop 60 to be positioned in a multitude of positions relative to the strap 32 to thereby accommodate batons of different lengths.

Figure 4:
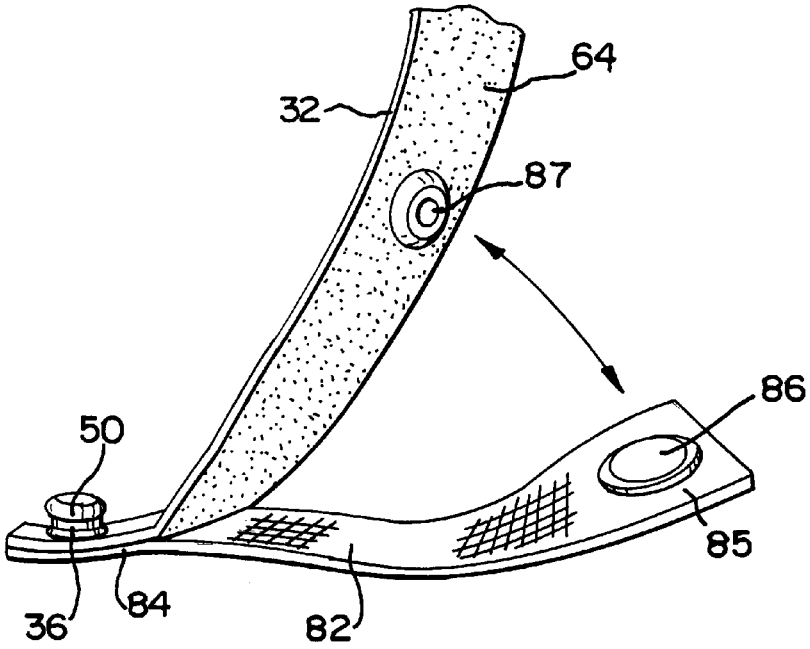
FIG. 4 is a perspective view of the second end of the scabbard, with the strap extension released from the rear of the strap in order to illustrate the male and female complimentary snap elements that snap together to form a belt receiving loop.

Referring now to FIG. 4, as noted above, the second end of the strap 32 in the preferred embodiment includes features to form a loop so as to receive a belt 39 worn around the waist of the user. The loop acts as a means for retaining the second end 36 of the strap 32 to the clothing or equipment worn by the user. In the preferred embodiment, the second end of the strap is provided with an extension member 82 connected to the second end 36 of the strap. The extension member 82 is made from the same nylon webbing, and has a first end 84 fixed to the second end 36 of the strap and a free end 85. A female snap element 86 is affixed to the free end 85 on one side. A complimentary male snap element 87 is affixed to the rear surface of the strap 32 proximate to the second end 36 of the strap. Engagement of male and female snap elements 86 and 87, respectively, forms a belt retaining loop 80 (FIG. 3), enabling the second end 36 of the strap to be retained by a belt 39 passing through the loop.

Figure 5:
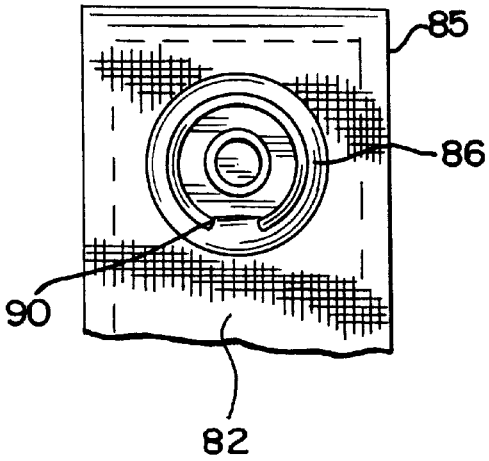
FIG. 5 is plan view of the female snap element affixed to the extension of the strap of FIG. 4.

Referring to FIGS. 4 and 5, in a preferred embodiment, the female snap element 86 is constructed with an inwardly projecting lip portion 90. The lip portion 90 cooperates with the male snap element 87 so as to prevent the free end 85 of the extension member 82 from being released from the strap 32 during the action of the user lifting the baton 22 upward to release the end of the baton from the baton retaining snap element 50. The lip portion 90 is positioned on the side of the female snap element 86 closest to the second end 36 of the strap. With the lip portion 90 in this position, the snap elements 86 and 87 will stay intact during release of the baton from the scabbard. The design also allows the user to remove the strap 32 from the belt 39 by pulling the free end 85 of the extension member away from the rear of the strap, thereby allowing the user to easily and quickly take off the scabbard without unfastening their belt. The belt-receiving loop 80 formed by joining the snap elements 86 and 87 is shown in a flattened condition in FIG. 3, as it would be when the scabbard 20 is worn on the user and pressed against the user's torso.

Figure 6:
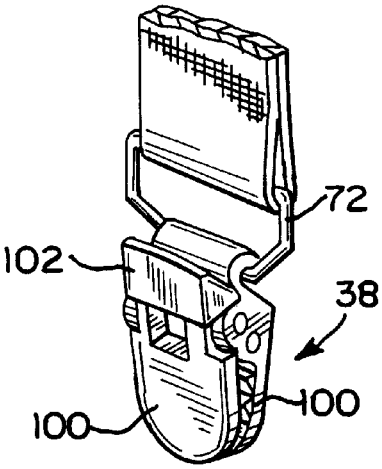
FIG. 6 is a perspective view of a locking clasp found at the second end of the strap of FIG. 2, which is designed to be affixed to the clothing worn by the user.

FIG. 6 is a detailed perspective view of the locking clasp 38 of FIG. 2 that anchors the first end 34 of the strap to the user's trousers. The clasp includes a pair of jaws 100 with sharp gripping teeth and a locking lever 102. When the lever 102 is lifted up, the jaws 100 open, enabling the clasp to be slipped over the top of the trousers. When the lever 102 is moved down, the jaws 102 are closed and locked in place to tightly grip the trousers. The clasp 38 has the break-away feature described above.

It will be appreciated that while the scabbard 20 is positioned on the user's torso in FIG. 2 such that the baton 22 is on the user's left side, the scabbard is reversible: i.e., the first and second ends 34 and 36 can be affixed to the user's clothing or equipment in the opposite condition such that the first end 34 is positioned on the user's left side and the second end 36 is positioned on the user's right side, resulting in the baton being located on the right hand side of the torso.

Further, it will be noted that by virtue of the scabbard 20 being worn about the torso, the baton may be carried in a concealed manner under a coat. Moreover, the position of the baton along the side and lower portion of the torso enables to the baton 22 to be carried with little or no restriction on the freedom of movement of the user. In particular, arm motion is not compromised. Further, the scabbard is not bulky.

The combination of the platform provided by the second end 36 of the strap 32, the snap element 50, and the loop 60 provide the required stability and restriction on the movement of the baton. There is a reduced risk of an adversary forcibly removing the baton 12 from the scabbard, since the loop 60 holds the baton against the body of the user.

In accordance with another feature of the invention, the baton is quickly removed from the scabbard and deployed. This is achieved in two motions, and takes about one second to complete. These motions will be described below in conjunction with all of the above-referenced drawing figures.

The first motion is a grasping of the handle 28 of the baton 22 and an upward lifting of the baton 22 in a short, quick motion. With reference to FIG. 2, this would be performed by the user's right hand reaching across their torso to grasp the lower portion of the handle 28. The lifting of the baton upward releases the male snap element 50 (FIG. 2A) from the female snap element 99 incorporated into the end cap 52 of the baton 22 (FIG. 2B). It is critical during this motion that the belt retaining loop 80 remain intact such that the belt 39 prevents the strap 32 from moving upward with the baton 22 more than a few inches. This is achieved by the locking modification to the female snap element 86 positioned on the extension member, as described above. (A permanent loop at the end 36 of the strap 32 would also achieve this result, but this is less desirable a construction since it would require the user to unfasten their belt 39, thread the end of the belt through the loop and refasten the belt in order to install the scabbard.)

Figure 1A:
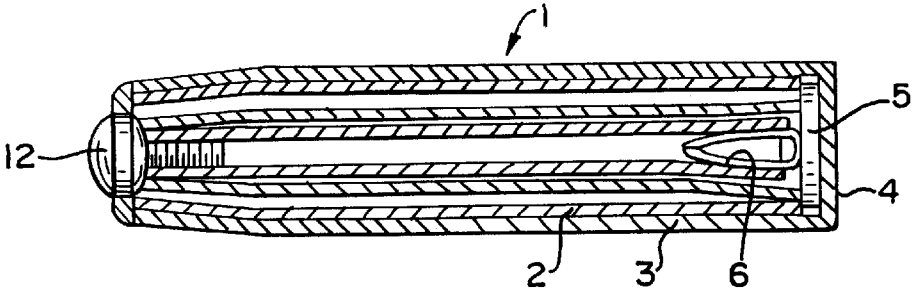
FIG. 1A PRIOR ART
FIG. 1A is a sectional view of a prior art expandable tactical police baton shown in a collapsed condition, such a baton being of the type suitable for use with the inventive scabbard.
Figure 1B:
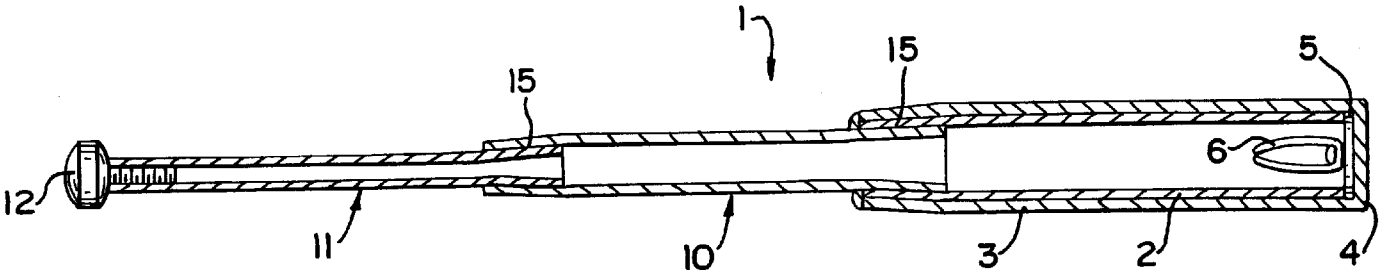
FIG. 1B PRIOR ART
FIG. 1B is a sectional view of the expandable baton of FIG. 1A shown in an extended condition, as it would be when deployed as an impact intermediate force weapon.

The second motion is a swift, short downward motion, in which the baton 22 is moved downward and completely withdrawn from the baton-receiving loop 60. Preferably, this downward motion is also a sweeping motion in which the baton is swept rapidly downwards and across the front of the user in a short stroke. This action completes the release of the baton 22 from the scabbard 20. This action has a second desirable effect: when the stroke is complete, the expandable baton 22 is extended from the collapsed condition to the extended position (See FIG. 1B), with the baton sections locked in place. The baton is thus immediately ready for use as an impact or defensive weapon.

Variations to the disclosed embodiment are contemplated as being within the spirit and scope of the invention. For example, different or more elaborate strap or harnesses arrangements may be used to carry the baton (for example, something akin to a suspender arrangement or a chest harness). Such an arrangement would have a snap or similar device to releasably retain the lower end of the baton and a loop receiving the upper portion of the baton. Accordingly, the term "elongated strap" as used in the claims is intended to cover such alternative configurations of the scabbard. Further, the article of clothing or equipment that the strap is adapted to attach to is essentially unimportant. Additionally, it is known to interchange the placement of male and female snap elements or hook and pile fastener with no difference in terms of the function, way or result of engaging two members together, or substitute equivalent types of structures, and the invention of course can be enjoyed with these types of variations.

In addition, the use of the term "means" in the claims is intended to invoke the provision of 35 U.S.C. § 112 in which such terms are construed to literally encompass not only the disclosed structures, materials or acts described in the above specification, but also to literally cover equivalents to such structures, materials or acts. This true spirit and scope of the invention is defined by the appended claims, as interpreted in light of the foregoing specification.

I claim:

1. A scabbard for carrying a baton on the body of a user in a manner such that the baton may be quickly released from the scabbard and placed into use, the baton comprising a handle to be grasped by the user having a first end portion, the scabbard comprising:

an elongated strap having a first end and a second end, said strap adapted to be worn about the torso of the user, said first end comprising a means for fastening the said strap to an article of clothing or equipment worn by the user and a second end adapted to be retained by a belt or other clothing or equipment worn proximate the waist of the user;

a retaining means affixed to said second end of said strap for cooperating with said first end portion of said handle of said baton for releasably securing said first end portion of said baton to said strap, the retaining means comprises a first snap element; and a loop attachable to said strap between the first and second ends, said loop positioned relative to said second end of said strap such that said baton is positionable within said loop when said first end portion of said baton is releasably secured to said retaining means.

2. The scabbard of claim 1, wherein said strap comprises a front surface and a rear surface and wherein complementary hook and pile fastener is applied to said loop and said rear surface of said strap between said first and second ends of said strap, respectively, thereby enabling said loop to be securely positioned in a multitude of positions intermediate said first and second ends of said strap to thereby accommodate batons of varying length carried by said scabbard.

3. The scabbard of claim 1, wherein said first end portion of said baton comprises a complementary snap element enabling said first end portion of said baton to be snapped to said second end of said strap.

4. The scabbard of claim 3, wherein said second end of said strap further comprises a loop, wherein the belt of the user is passed through said loop to retain said strap to the user.

5. The scabbard of claim 1, wherein said second end of said strap further comprises:

a) an extension member either affixed to or integral with said second end of said strap and having a free end;

b) a first snap element affixed to said free end of said extension member; and c) a complimentary snap element affixed to said strap proximate to said second end of said strap;

d) wherein the engagement of said first snap element to said complimentary snap element forms a belt retaining loop at said second end of said strap, enabling said second end of said strap to be retained by a belt passing through said belt retaining loop.

6. The scabbard of claim 5, wherein at least one said first snap element or said complimentary snap element is constructed so as to lockingly engage with the other of said snap elements to prevent said free end of said extension member from being released from said strap during the action of the user releasing said first end portion of said baton handle from said scabbard.

7. The scabbard of claim 1, wherein said first end of said strap comprises a clasp adapted to attach to an article of clothing, and wherein said clasp is adapted to break away from said article of clothing in the event that substantial pull-out forces are applied to said elongate strap.

8. The scabbard of claim 1, wherein said strap further comprises a length adjustment member intermediate said first end of said strap and said second end of said strap, said length adjustment member receiving said strap and cooperating with said strap to vary the length of said strap, thereby permitting said strap to be adjusted in length to fit a plurality of users of different sizes.

9. A scabbard for carrying a baton on the body of a user of the baton in a manner such that the baton may be quickly released from the scabbard and placed into use, the baton comprising a handle to be grasped by the user and having a first end portion, the scabbard comprising:

a strap to be worn about the torso of the user having a first portion having a means for fastening the strap to an article of clothing or equipment worn by the user and a second portion having a means for securing the strap to an article of clothing or equipment worn by the user;

a retaining means affixed to said strap for cooperating with said first end portion of said handle of said baton for releasably securing said first end portion of said baton to said strap; and an elastic loop having a circumference sufficient for receiving said baton attached to said strap, said loop positioned relative to said retaining means such that a portion of said baton may be positioned within said loop when said first end portion of said baton is releasably secured to said retaining means.

10. The scabbard of claim 9, wherein said loop is positioned on said strap such that when the strap is worn by the user and the first end portion of the baton is releasably secured to said retaining means, said baton is oriented in a substantially vertical orientation with said loop positioned substantially above said retaining means.

11. The scabbard of claim 9, wherein said strap comprises an elongate strap having a first end and a second end and a sufficient length such that when said second end is attached to a belt worn around the waist of the user in the front of the torso, said strap may pass upwards from said belt, around the back of the user's neck, and down across the front of the torso such that said first end may attach to an article of clothing or equipment at the waist of the user.

12. The scabbard of claim 9, wherein said strap comprises a front surface and a rear surface and wherein complementary hook and pile fastener is applied to said loop and said rear surface of said strap, respectively, thereby enabling said loop to be securely positioned in a multitude of positions to thereby accommodate batons of varying length carried by said scabbard.

13. A method for carrying a baton in a scabbard on the body of the user and releasing said baton from the scabbard, the scabbard securely attached to the clothing or equipment worn by the user, comprising the steps of:

releasably attaching a first end of said baton to said scabbard at a location proximate to the waist of said user, securing the baton to the torso of the user by placing a second end of said baton within a loop positioned substantially vertically disposed above said first end of said baton; and releasing the baton from the scabbard by grasping the baton, lifting upward on the baton to release the first end of the baton from the engagement of the baton to the scabbard, and moving the baton downward in a stroke so as to withdraw said baton from said loop to thereby completely release said baton from said scabbard.

14. The method of claim 13, wherein said baton comprises an expandable baton having a first section and a second section, and wherein said step of moving said baton downward results in said baton being moved into an expanded condition such that said first and second sections are extended and locked into a deployed condition.

15. A scabbard for carrying a baton on the body of a user of the baton in a manner such that the baton may be quickly released from the scabbard and placed into use, the baton comprising a handle to be grasped by the user having a first end portion, the scabbard comprising:

an elongate strap to be worn about the torso of the user having a first end comprising a clasp for fastening the strap to an article of clothing worn by the user and a second end having a first snap element and an extension member having a second snap element cooperable with said first snap element to form a belt-receiving loop at said second end of said strap;

a male snap element affixed to said second end of said strap that cooperates with a female snap element incorporated into said first end portion of said handle of said baton to thereby releasably secure said first end portion of said baton to said strap; and a loop having a circumference sufficient to receive said baton attached to said strap, the loop either fixed to said strap or capable of being secured to said strap at a plurality of intermediate positions relative to said male snap element such that a portion of said baton may be received within said loop when said first end portion of said baton is releasably secured to said male snap element.

16. The scabbard of claim 15, wherein said strap is made from a non-stretch nylon webbing.

17. The scabbard of claim 15, further comprising hook and pile fastener applied to said loop and said strap enabling said loop to be attached to said strap in a plurality of positions.

18. The scabbard of claim 15, wherein at least one of said first and second snap elements is adapted to lock onto the other of said snap elements to thereby prevent release of the first and second elements when the user releases the baton from said male snap element.

19. The scabbard of claim 15, wherein said clasp breaks-away from said article of clothing worn by the user in the event that substantial pull-out forces are applied to said elongate strap.

20. The scabbard of claim 15, wherein said loop is made of an elastic material.

21. The scabbard of claim 1, wherein said loop is made of an elastic material.

* * * * *